US010337125B2

(12) United States Patent
Decker et al.

(10) Patent No.: US 10,337,125 B2
(45) Date of Patent: Jul. 2, 2019

(54) HEATING DEVICE FOR PRODUCING CARBON FIBERS

(71) Applicants: CLARIANT INTERNATIONAL LTD., Muttenz (CH); Linn High Therm GmbH, Eschfelden (DE)

(72) Inventors: Daniel Decker, Liederbach (DE); Michael Woelki, Frankfurt am Main (DE); Phillip Schwerdt, Mainz-Kastel (DE); Horst Linn, Eschenfelden (DE); Rudolf Linn, Hersbruck (DE); Juergen Kunstmann, Bad Soden (DE)

(73) Assignees: CLARIANT INTERNATIONAL LTD., Muttenz (CH); LINN HIGH THERM GMBH, Eschfelden (DE)

( * ) Notice: Subject to any disclaimer, the term of this patent is extended or adjusted under 35 U.S.C. 154(b) by 0 days.

(21) Appl. No.: 15/123,296

(22) PCT Filed: Feb. 27, 2015

(86) PCT No.: PCT/EP2015/000457
§ 371 (c)(1),
(2) Date: Sep. 2, 2016

(87) PCT Pub. No.: WO2015/131990
PCT Pub. Date: Sep. 11, 2015

(65) Prior Publication Data

US 2017/0073846 A1 Mar. 16, 2017

(30) Foreign Application Priority Data

Mar. 3, 2014 (DE) ..... 10 2014 003 126

(51) Int. Cl.
*H05B 6/10* (2006.01)
*H05B 6/02* (2006.01)
(Continued)

(52) U.S. Cl.
CPC ..... *D01F 9/328* (2013.01); *D01F 9/12* (2013.01); *D01F 9/32* (2013.01); *D02J 13/001* (2013.01);
(Continued)

(58) Field of Classification Search
CPC ..... H05B 6/108; H05B 6/44; D02J 13/001; D02J 13/005; D01F 9/12; D01F 9/32; D01F 9/328
(Continued)

(56) References Cited

U.S. PATENT DOCUMENTS 3,883,718 A * 5/1975 Ferment ..... D06B 3/045 219/388
3,900,540 A * 8/1975 Robba ..... C01B 21/064 264/166
(Continued)

FOREIGN PATENT DOCUMENTS

DE 30 31 303 3/1981
DE 37 87 582 3/1994
(Continued)

OTHER PUBLICATIONS

PCT International Search Report for PCT/EP2015/000457, dated Jun. 5, 2015.
(Continued)

*Primary Examiner* — Hung D Nguyen
(74) *Attorney, Agent, or Firm* — Tod A. Waldrop

(57) ABSTRACT

A heating device for producing carbon fibers from a thread-shaped fiber starting material, wherein the heating device has a central tubular induction heating element through which the fiber starting material is moved. The tubular induction heating element is surrounded by thermal insulation. At least one mid- to high-frequency induction coil is provided outside the thermal insulation, and an inert gas
(Continued)

flows through the central induction heating element, in particular, for carbonizing and/or graphitizing the fiber starting material. For energy optimization, a first and a second tube element is provided on the outer side of the thermal insulation. The elements are made of material that is transparent to the induction field of the mid- to high-frequency induction coil and are spaced apart from one another by an annular gap through which the inert gas flows.

14 Claims, 2 Drawing Sheets

(51) Int. Cl.

| | |
|---|---|
| ***D01F 9/32*** | (2006.01) |
| ***D02J 13/00*** | (2006.01) |
| ***D01F 9/12*** | (2006.01) |
| ***H05B 6/44*** | (2006.01) |

(52) U.S. Cl.
CPC ..... *D02J 13/005* (2013.01); *H05B 6/108* (2013.01); *H05B 6/44* (2013.01)

(58) Field of Classification Search
USPC ..... 219/388, 390, 601, 635, 636
See application file for complete search history.

(56) References Cited

U.S. PATENT DOCUMENTS

| | | | | |
|---|---|---|---|---|
| 4,054,708 | A | 10/1977 | Robba et al. | |
| 4,321,446 | A | 3/1982 | Ogawa et al. | |
| 4,469,925 | A | 9/1984 | Toshiro et al. | |
| 4,820,905 | A * | 4/1989 | Iwata | D01F 9/32 219/388 |
| 4,914,276 | A * | 4/1990 | Blair | C30B 31/12 219/390 |
| 6,027,337 | A | 2/2000 | Rogers et al. | |
| 2001/0033035 | A1 | 10/2001 | Panter et al. | |
| 2003/0056930 | A1 * | 3/2003 | Plata | B22D 17/007 164/80 |
| 2003/0102304 | A1 * | 6/2003 | Boyers | C03C 23/00 219/635 |
| 2018/0031321 | A1 | 2/2018 | Decker et al. | |

FOREIGN PATENT DOCUMENTS

| | | |
|---|---|---|
| GB | 808 442 | 2/1959 |
| JP | S4844306 | 6/1973 |
| JP | S5643423 | 4/1981 |
| JP | S59131879 | 7/1984 |
| JP | H06129778 | 5/1994 |
| JP | H07118933 | 5/1995 |
| JP | H10272534 | 10/1998 |

OTHER PUBLICATIONS

PCT International Preliminary Report on Patentability for PCT/EP2015/00457, dated Sep. 6, 2018.
Machine Translation of JP06129778, May 13, 1994.
Machine Translation of JPH07118933, May 9, 1995.
Machine Translation of JPH10272534, Oct. 13, 1998.
Machine Translation of JPS564323, Apr. 22, 1981.
Machine Translation of JPS59131879, Jul. 28, 1984.

* cited by examiner

HEATING DEVICE FOR PRODUCING CARBON FIBERS

The invention concerns a heating device for producing carbon fibers from a threadlike fiber starting material, wherein the heating device has a central tubular induction heating element, through which the fiber starting material is moved, the tubular induction heating element is surrounded by a thermal insulation, the heating source is an induction coil outside the thermal insulation, and the central induction heating element receives a flow of inert gas in particular for the carbonization and/or graphitization of the fiber starting material.

U.S. Pat. No. 4,469,925 discloses a heating device for workpieces of carbon with a first thermal insulation layer of carbon powder and a second thermal insulation layer of a mixture of carbon and silicon powder.

From DE 37 87 582 T2 there is known a carbonization oven with a thermal insulation, which is composed of a carbon fiber felt and a ceramic fiber felt. The carbon fiber felt and the ceramic fiber felt are spaced apart from each other.

From DE 30 31 303 C2 there is known a heating device for producing carbon fibers, in which the heating source is formed by a high frequency induction coil. The thermal insulation consists of carbon particles having an average grain diameter of 0.5 to 1.5 mm and an angle of repose of ≤35°. The carbon particles are obtained by granulation of soot powder, having an average grain diameter of around 50 to 300 μm, with a binder and by carbonization of the binder. The thermal insulation in this known heating device can consist of a relatively thin layer of carbon fiber felt and a layer of carbon particles provided around this felt layer. The carbon fiber felt layer there is, for example, 10 to 15 mm, because it is slightly subject to an induction by the high frequency generated by the high frequency coil, as is stated in column 8, lines 45 to 51. The thermal insulation of this known heating device is provided in a tube of a heat-resistant material, immediately adjacent to the latter. The tube of the heat-resistant material is hermetically sealed at its two axially separated ends by cover elements. One of the two cover elements is fashioned with a gas inlet and a gas outlet for the inert gas. The inert gas is, for example, nitrogen, argon, helium or the like.

This vertically oriented heating device has shortcomings in regard to its energy balance, although there is no denying that its energy balance is better than that of a heating device of this kind which uses an electrical resistance heating instead of a high frequency induction coil.

The problem which the invention proposes to solve is to create a heating device of the kind mentioned above in which the energy balance is significantly improved by simple design means.

This problem is solved according to the invention by the features of claim 1, i.e., in that the heating source is formed by at least one medium to high frequency induction coil, and in that on the outside of the thermal insulation there are provided a first and a second tube element of material transparent to the induction field of the medium to high frequency induction coil, which are separated from each other by an annular gap, through which the inert gas flows.

The heating device according to the invention uses, as its heating source, a medium to high frequency induction coil. In the frequency range of the induction coil, the thermal insulation used according to the invention is transparent, i.e., an unwanted dissipation of the induction field in the thermal insulation is negligible.

Thanks to the fact that the inert gas in the heating device according to the invention flows not only through the central tubular induction heating element but also upstream from that through the annular gap between the first and the second tube element on the outside of the thermal insulation, an energy savings is advantageously accomplished, because cold inert gas is heated in said annular gap, so that it enters into the central tubular induction heating element with a higher temperature and the desired high temperature here, especially for the carbonization and/or graphitization of the threadlike fiber starting material, is achieved with an overall reduced energy input.

For the targeted guidance of the inert gas through the annular gap between the first and the second tube element it has proven to be advantageous to provide gas guiding elements in said annular gap. The gas guiding elements can be guide ribs, knobs, or the like. With the aid of the gas guiding elements, the dwell time of the inert gas in the annular gap is increased in a defined manner. The preheating or heating of the inert gas at the outlet point from the annular gap is proportional to this increasing of the dwell time.

It is especially helpful here for the inert gas to be guided in counterflow through the annular gap between the first and the second tube element and through the central tubular induction heating element, i.e., for the inert gas to be directed through the annular gap in one axial direction and in the central tubular induction heating element in the axially opposite direction. This counterflow guidance of the inert gas can be implemented in a simple design manner.

An optimal carbonization and/or graphitization of the threadlike fiber starting material can be achieved according to the invention in that the inert gas is directed through the central induction heating element in the one axial direction and at the same time the threadlike fiber starting material is moved in the opposite direction through the induction heating element.

The heating device according to the invention can be used to move at least one fiber starting material thread through the central tubular induction heating element. From the standpoint of productivity, it is advantageous when the heating device according to the invention is designed to move a number of fiber starting material threads through the central induction heating element at the same time, the fiber starting material threads lying spaced apart from each other in one plane or in several planes. In such a heating device of the last mentioned kind, the induction heating element can have a round circular or an oval annular cross section. Accordingly, the thermal insulation surrounding the central tubular induction heating element can have an outer envelope surface which is circular round or oval adapted to the oval annular cross section.

It has proven to be advantageous in the heating device according to the invention to use as the heating source a medium to high frequency induction coil when the thermal insulation consists of a carbon fiber felt. Likewise, it is possible according to the invention for the thermal insulation to have an inner layer of a carbon fiber felt and an outer layer of, for example, $Al_2O_3$ fibers or of $Al_2O_3/SiO_2$ fibers.

The efficiency of the heating device according to the invention can be further improved in advantageous manner, i.e., increased, when the thermal insulation is spaced apart from the central tubular induction heating element by an annular gap through which a partial amount of the inert gas flows. The flow of the inert gas occurs here in the aforementioned annular gap and the flow of inert gas in the central tubular induction heating element advisedly occurs in the same direction, i.e., in directions parallel to each other.

At the two axially opposite ends of the central tubular induction heating element and the first and second tube element of the heating device according to the invention there is provided a cover element each time. The two cover elements are placed hermetically tight against the outside tube element.

It has proven to be advantageous in the heating device according to the invention to provide the one cover element for the diverting of the inert gas from the annular gap between the first and the second tube element to the central tubular induction heating element and the other cover element for the introducing of the inert gas into the annular gap between the first and the second tube element and for bringing the inert gas out from the central tubular induction heating element.

An air lock for the threadlike fiber starting material being carbonized and/or graphitized is preferably respectively provided on each of the two cover elements on the outside.

The cover elements are advisedly each outfitted with a cooling device. The coolant can be water, for example.

It is advantageous for the central tubular induction heating element to consist of CFC (=carbon fiber-reinforced carbon). It is especially advantageous for the carbon fibers used as the reinforcement to be endless fibers.

At the two end sections facing away from each other axially in the central tubular induction heating element there is advisedly respectively provided a radiation shielding perforated disk in order to minimize possible heat losses in the central tubular induction heating element and consequently optimize the efficiency of the heating device. It can be useful for the same purpose to have provided in each case adjacent to the two end faces of the thermal insulation facing away from each other axially at least one radiation shielding annular disk.

The cover elements of the heating device according to the invention can consist, for example, of aluminum, an aluminum alloy, refined steel or the like. The cooling of the cover elements can involve a water cooling, for example, as already mentioned.

It can be advantageous in the heating device according to the invention to provide at least the first tube element adjacent to the thermal insulation with an infrared reflecting coating on the inside and/or the outside. The infrared reflecting coating can be a full-surface or a partial coating. In the case of a partial coating, this can be in the form of stripes, a lattice, spots or the like.

Further details, features and benefits will emerge from the following description of a sample embodiment of the heating device according to the invention as shown schematically in the drawing.

BRIEF DESCRIPTION OF THE DRAWINGS

FIG. 1 shows schematically a configuration of the heating device 10 for producing carbon fibers from a threadlike fiber starting material 12. The threadlike fiber starting material 12 is a carbon-containing fiber material suitable for producing carbon fibers, preferably a fiber material based on PAN (=polyacrylonitrile).

Figure 1:
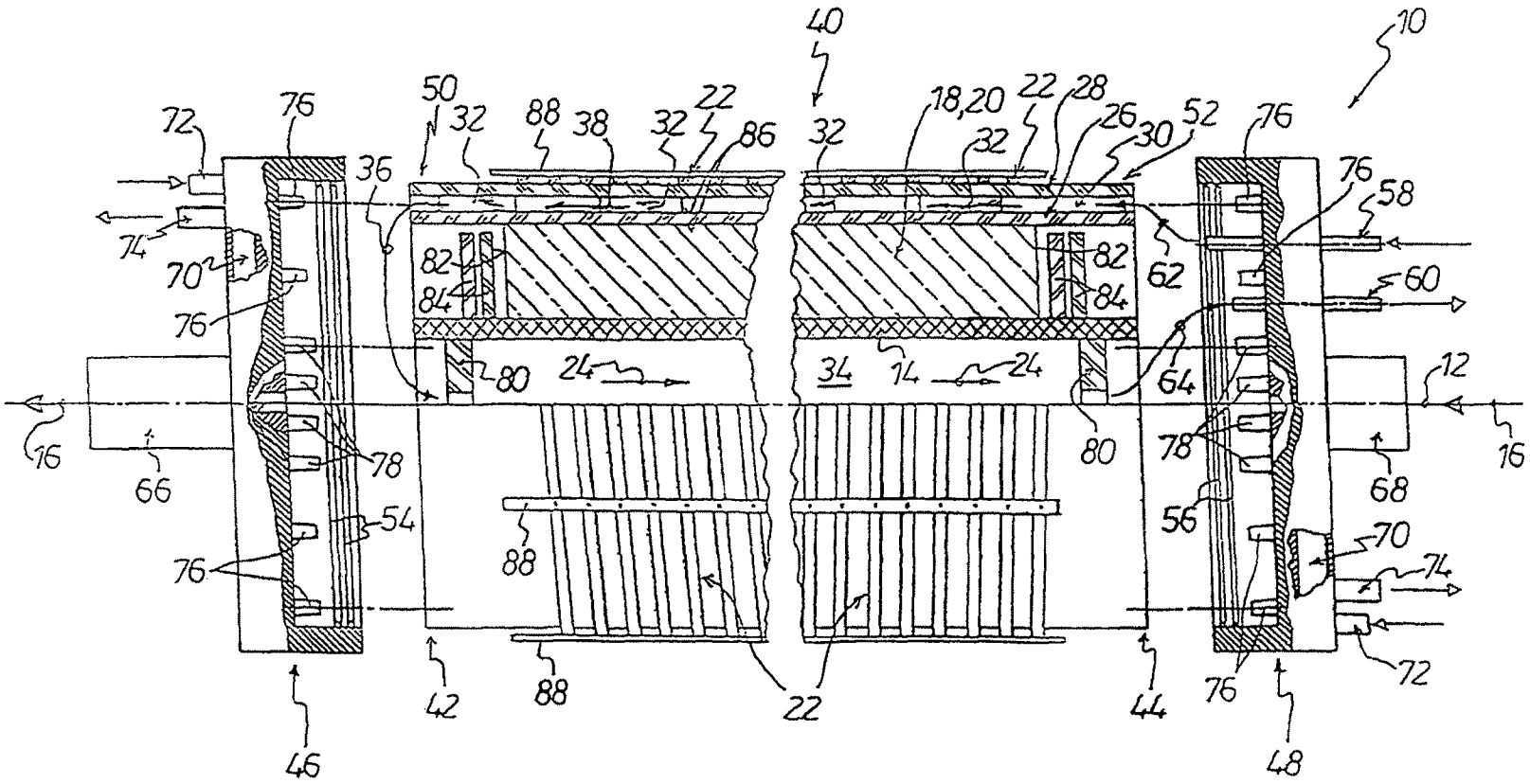
FIG. 1, in half-section, segment-wise, an embodiment of the heating device, wherein the two cover elements axially facing away from each other and axially spaced away from the self-supporting central body of the heating device are shown partially cut open, FIG. 2, longitudinally cut on one side, another embodiment of the central body of the heating device, and FIG. 3, a representation similar to FIG. 2 of yet another embodiment of the central body of the heating device.

Threadlike fiber starting material for producing carbon fibers is oxidized in known manner in a first process step at temperatures up to 400° C., then carbonized at 400° C. to around 1600° C. and then graphitized at 1600° C. to 2800° C. The heating device according to the invention is used in particular for the carbonization of the threadlike fiber starting material. However, it will be understood that the heating device according to the invention with proper dimensioning of the at least one medium to high frequency induction coil can also be used for the graphitization of the threadlike fiber starting material. Optionally, a heating device according to the invention can be used for the carbonization in combination with another heating device according to the invention for the graphitization.

Yet another option is to configure the heating device according to the invention with multiple zones, i.e., to design the medium to high frequency induction coil in multiple parts, where at least one medium to high frequency induction coil is provided for the carbonization and at least one other medium to high frequency induction coil is provided for the graphitization of the threadlike fiber starting material.

The heating device 10 has a central tubular induction heating element 14, through which the threadlike fiber starting material is moved. The direction of movement of the threadlike fiber starting material 12 is indicated by the arrow 16.

The central tubular induction heating element 14 preferably consists of CFC (=carbon fiber-reinforced carbon). It is especially advantageous for the carbon fibers used as the reinforcement to be endless fibers. Of course, other heat-resistant materials inductively coupling the induction field of the medium to high frequency induction coil, such as tungsten or the like, could also be used. But as compared to materials of the latter mentioned kind, CFC has the substantial advantage of a low procurement price.

The central tubular induction heating element 14 is surrounded by a thermal insulation 18. The thermal insulation 18 consists of a carbon fiber felt 20.

Outside the thermal insulation 18 of carbon fiber felt 20, there is provided an induction coil as the heating source, being a medium to high frequency induction coil 22, which is operated for example with a frequency of around 5 kHz to around 40 kHz, it being understood that other frequencies can also be used. In the frequency range employed, the thermal insulation 18 of carbon fiber felt 20 is transparent to the induction field generated by the induction coil 22, i.e., the coupling of the induction field in the thermal insulation 18 is negligible.

The central tubular induction heating element 14 receives a flow of an inert gas for the carbonization and/or graphitization of the threadlike fiber starting material 12. This is indicated by the arrows 24.

As is evident from FIG. 1, the inert gas is guided through the central tubular induction heating element 14 in the one axial direction as indicated by the arrows 24. At the same time, the threadlike starting material 12 being carbonized and/or graphitized is moved in the opposite direction as indicated by the arrow 16 through the central tubular induction heating element 14.

In order to achieve a heating device 10 with a comparatively high efficiency according to the invention, a first tube element 26 is provided on the outside of the thermal insulation 18 and at a radial spacing from this a second tube element 28, consisting of a material transparent to the induction field of the induction coil 22. This material is, for example, quartz glass. It is also possible for the first tube element 26 to consist of quartz glass, for example, and the second tube element 28 of borosilicate glass.

The two tube elements 26 and 28 are spaced apart from each other by an annular gap 30. The inert gas flows through the annular gap 30. In order to guide the inert gas flow in the annular gap 30 in a defined manner and in this way prolong the dwell time of the inert gas in the annular gap 30, it has proven to be advantageous to provide a number of gas guiding elements 32 in the annular gap 30. The gas guiding elements 32 consist advisedly of the same material as the first and/or second tube element 28.

In the annular gap 30 the inert gas is heated by the induction field of the medium to high frequency induction coil 22. The heated inert gas is then introduced into the central space 34 of the tubular induction heating element 14. This is indicated in FIG. 1 by the arc-shaped arrow 36. As is clearly seen, the inert gas is guided through the annular gap 30 between the first and the second tube element 26 and 28 in the one direction as indicated by the arrow 38 and then through the central tubular induction heating element 14 in the opposite direction as indicated by the arrows 24, i.e., in counterflow.

In particular, when the heating device 10 according to the invention is a heating device, for example, for a laboratory facility or the like, the heating device 10 is provided for one fiber starting material thread 12. In industrial use, the heating device 10 is preferably designed so that a number of fiber starting material threads 12 can be moved at the same time through the central tubular induction heating element 14, the fiber starting material threads 12 lying preferably at a spacing from each other in at least one common plane or in several planes slightly spaced apart from each other. This plane or these planes are perpendicular to the plane of the drawing in FIG. 1.

The central tubular induction heating element 14 with the thermal insulation 18, the first and the second tube element 26 and 28 and the medium to high frequency induction coil 22 form a self-supporting central body 40 of the heating device 10, at whose ends 42, 44 axially facing away from each other is provided one cover element 46, 48 for each. The cover elements 46 and 48 are only shown very schematically in FIG. 1 and spaced apart from the central body 40. In the assembled state of the heating device 10, the cover elements 46, 48 are hermetically sealed against the end sections 50, 52 of the outside second tube element 28. This is indicated by sealing bulges 54, 56, for example, with which the cover elements 46, 48 are provided.

The cover element 46 is provided for diverting the inert gas from the annular gap 30 between the first and the second tube element 26, 28 to the central tubular induction heating element 14, i.e., for diverting it into its central space 34, as indicated by the arc-shaped arrow 36. For this purpose, the cover element 46 is preferably designed with a deflection cavity for the inert gas (not shown). The other opposite cover element 48 is provided for introducing the inert gas into the annular gap 30 between the first and the second tube element 26, 28 and for bringing the inert gas out from the central space 34 of the central tubular induction heating element 14. For this purpose, the cover element 48 likewise only shown very schematically is provided with an inlet 58 for the inert gas and an outlet 60 for bringing it out, while the cover element 48 is likewise designed with partial cavities (not shown) which are associated with the inlet 58 and the outlet 60.

The introducing of the inert gas into the cover element 48 is indicated by the arrow 62 and the bringing out of the inert gas from the cover element 48 by the arrow 64.

On the outside of the cover element 46 is provided an air lock 66 and on the outside of the cover element 48 an air lock 68 for the threadlike fiber starting material 12 being carbonized and/or being graphitized or carbonized and/or graphitized. Each cover element 46, 48 is respectively designed with a cooling system 70, which is a water cooling, for example. The reference number 72 designates a coolant inlet and the reference number 74 a coolant outlet corresponding to the respective coolant inlet 72.

The respective cover element 46, 48 is provided on the inside with a positioning and centering pin 76 slightly tapering as a truncated cone, which in the assembled condition of the cover elements 46, 48 with the central body 40 protrudes almost free of play into the annular gap 30 between the first and the second tube element 26, 28. The cover elements 46, 48 furthermore are provided on the inside with positioning and centering pins 78, which likewise interact free of play with the central tubular induction heating element 14 in the assembled condition of the heating device 10.

In the central tubular induction heating element 14 at the two end sections facing axially away from each other there is provided a radiation shielding perforated disk 80 for each, in order to localize the heat generated by the induction heating element 14 in the central space 34. Next to each of the two end faces 82 axially facing away from each other of the thermal insulation 18 is placed at least one radiation shielding annular disk 84. In FIG. 1, two radiation shielding annular disks 84 are in each case shown at slight axial distance from each other.

At least the first tube element 26 next to the thermal insulation 18 can be provided with an infrared reflecting coating 86 on the inside and or the outside. The reflecting coatings can be full-surface or partial-surface. In the case of a partial coating, this can be configured, for example, as stripes, a lattice, spots arranged chaotically or in a grid.

The reference number 88 designates axially oriented strip elements, by means of which the turns of the medium to high frequency induction coil 22 are joined together and spaced apart from each other in a defined manner.

Figure 2:
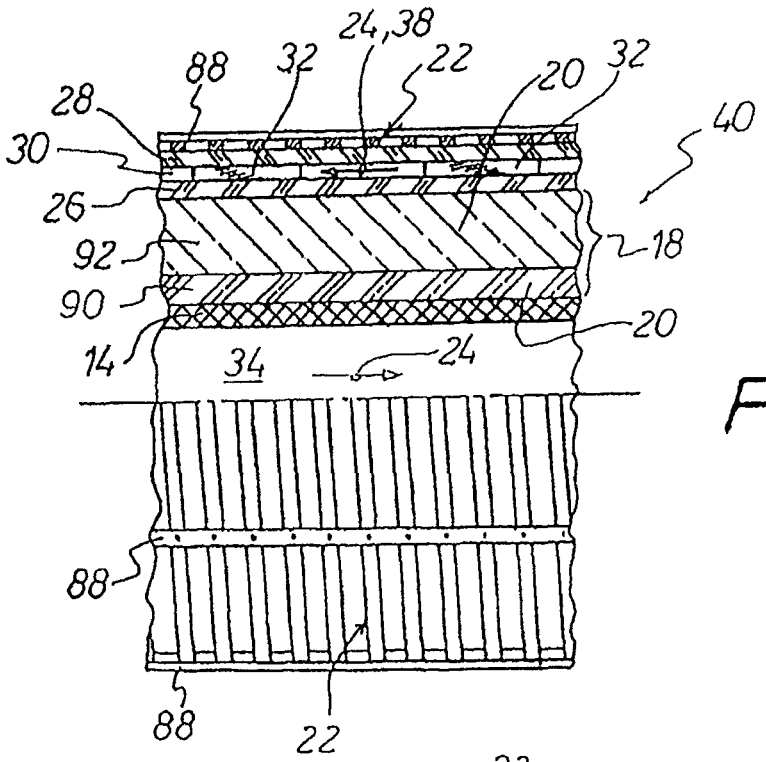

FIG. 1 shows schematically an embodiment of the heating device 10 in which the thermal insulation 18—as mentioned—consists of a carbon fiber felt 20. On the other hand, FIG. 2 shows in partial longitudinal sectioning an embodiment of the central body 40 where the thermal insulation 18 has an inner layer 90 and an outer layer 92. The inner layer 90 consists of a carbon fiber felt 20 and the outer layer 92 of $Al_2O_3$ fibers, for example.

The same parts in FIG. 2 are designated with the same reference numbers as in FIG. 1, so that it is unnecessary to describe in detail once more all items in connection with FIG. 2.

Figure 3:
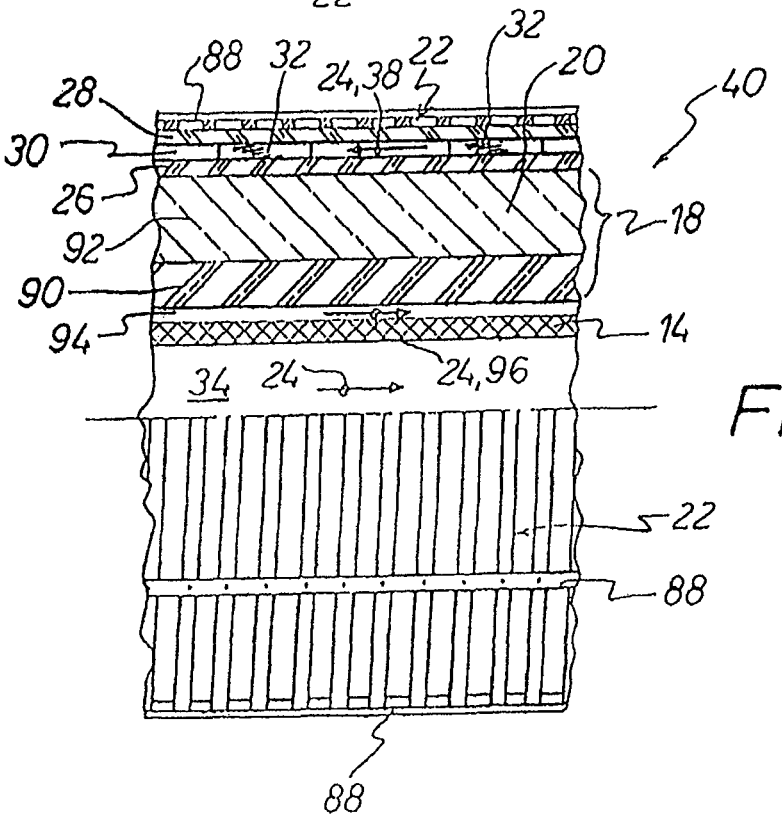

FIG. 3 illustrates, in a half-sided longitudinal section similar to FIG. 2, a feature of the self-supporting central body 40 of the heating device according to the invention. This embodiment differs from the embodiment shown schematically in FIG. 2 in that the thermal insulation 18 is spaced apart from the central tubular induction heating element 14 by an annular gap 94, through which the inert gas flows. This is indicated by the arrow 96.

The same parts in FIG. 3 are also designated with the same reference numbers as in FIGS. 1 and 2, so that it is unnecessary to describe in detail once more all items in connection with FIG. 3.

LIST OF REFERENCE NUMBERS

10 Heating device (for 12)
12 Threadlike fiber starting material
14 Central tubular induction heating element (of 10)
16 Arrow/direction of movement (of 12)
18 Thermal insulation (of 10 for 14)
20 Carbon fiber felt (of 18)
22 Medium to high frequency induction coil (of 10 for 14)
24 Arrow/inert gas (for 12)
26 First tube element (of 10)
28 Second tube element (of 10)
30 Annular gap (between 26 and 28)
32 Gas guiding elements (in 30)
34 Central space (of 14)
36 Arc-shaped arrow (between 30 and 34)
38 Arrow (in 30)
40 Self-supporting central body (of 10)
42 End (of 40)
44 End (of 40)
46 Cover element (at 42)
48 Cover element (at 44)
50 End section (of 28)
52 End section (of 28)
54 Sealing bulge (of 46 for 50)
56 Sealing bulge (of 48 for 52)
58 Inlet (at 48)
60 Outlet (at 48)
62 Arrow (between 58 and 30 in 52)
64 Arrow (between 34 and 60)
66 Air lock (at 46, 48)
68 Air lock (at 48, 48)
70 Cooling device (of 46, 48)
72 Coolant inlet (at 46 for 70)
74 Coolant outlet (at 46 for 70)
76 Positioning and centering pin (at 46, 48 for 32)
78 Positioning and centering pin (at 46, 48 for 14)
80 Radiation shielding perforated disk (in 34)
82 End face (of 18)
84 Radiation shielding annular disk (at 82)
86 Infrared reflecting coating (of 26 and/or 28)
88 Strip element (of 22)
90 Inner layer (of 18)
92 Outer layer (of 18)
94 Annular gap (between 14 and 18)
96 Arrow (in 94)

The invention claimed is:

1. A heating device for producing carbon fibers from a threadlike fiber starting material, wherein the heating device comprises a central tubular induction heating element through which the fiber starting material is moved, the tubular induction heating element is surrounded by a thermal insulation, the heating device is an induction coil outside the thermal insulation and the central tubular induction heating element receives a flow of inert gas, wherein a heating source is formed by at least one medium to high frequency induction coil, and on the outside of the thermal insulation there are provided a first and a second tube element of material transparent to the induction field of the induction coil, which are separated from each other by an annular gap, through which the inert gas flows, the inert gas is guided in counter flow through the annular gap between the first and the second tube element and through the central tubular induction heating element, wherein at the two axially opposite ends of the central tubular induction heating element and the first and second tube element there is provided a cover element each time, wherein the one cover element is provided for the diverting of the inert gas from the annular gap between the first and the second tube element to the central tubular induction heating element and the other cover element for the introducing of the inert gas into the annular gap between the first and the second tube element and for bringing the inert gas out from the central tubular induction heating element.

2. The heating device as claimed in claim 1, wherein gas guiding elements are provided in the annular gap between the first and the second tube element.

3. The heating device as claimed in claim 1, wherein the inert gas is directed through the central induction heating element in the one axial direction and at the same time the threadlike fiber starting material is moved in the opposite direction through the induction heating element.

4. The heating device as claimed in claim 1, wherein at least one fiber starting material thread is moved through the central induction heating element.

5. The heating device as claimed in claim 4, wherein a number of fiber starting material threads are moved through the central induction heating element at the same time, the fiber starting material threads lying spaced apart from each other in one plane or in several planes.

6. The heating device as claimed in claim 1, wherein the thermal insulation consists of a carbon fiber felt.

7. The heating device as claimed in claim 6, wherein the thermal insulation is spaced apart from the central tubular induction heating element by an annular gap through which the inert gas flows.

8. The heating device as claimed in claim 1, wherein the thermal insulation has an inner layer of a carbon fiber felt and an outer layer of $Al_2O_3$ fibers or of $Al_2O_3/SiO_2$ fibers.

9. The heating device as claimed in claim 1, wherein an air lock for the threadlike fiber starting material is provided on each of the two cover elements on the outside.

10. The heating device as claimed in claim 1, wherein the cover elements are each designed with a cooling device.

11. The heating device as claimed in claim 1, wherein the central tubular induction heating element consists of carbon fiber-reinforced carbon, and the carbon fibers used as the reinforcement are formed by endless fibers.

12. The heating device as claimed in claim 1, wherein at the two end sections facing away from each other axially in the central tubular induction heating element there is provided a radiation shielding perforated disk.

13. The heating device as claimed in claim 1, wherein adjacent to the two end faces of the thermal insulation facing away from each other axially there is provided in each case at least one radiation shielding annular disk.

14. The heating device as claimed in claim 1, wherein at least the first tube element adjacent to the thermal insulation is provided with an infrared reflecting coating on the inside, the outside or both the inside and the outside.

* * * * *